United States Patent [19]

Baur

[11] Patent Number: 4,531,801

[45] Date of Patent: Jul. 30, 1985

[54] PLUG AND RECEPTACLE CONNECTOR LOCKING MEANS

[75] Inventor: Robert Baur, Los Angeles, Calif.

[73] Assignee: Automation Industries, Inc., Greenwich, Conn.

[21] Appl. No.: 577,974

[22] Filed: Feb. 8, 1984

[51] Int. Cl.[3] ..... H01R 13/623

[52] U.S. Cl. ..... 339/89 M; 339/113 R; 339/DIG. 2

[58] Field of Search ..... 339/113 R, 89 R, 89 C, 339/89 M, 90 R, 90 C, DIG. 2

[56] References Cited

U.S. PATENT DOCUMENTS

| | | | |
|---|---|---|---|
| 4,066,315 | 1/1978 | Arneson | 339/89 M |
| 4,468,077 | 8/1984 | Brush, Sr. et al. | 339/89 M |

FOREIGN PATENT DOCUMENTS

| | | | |
|---|---|---|---|
| 981700 | 5/1951 | France | 339/89 M |
| 2103892 | 2/1983 | United Kingdom | 339/89 M |

*Primary Examiner*—John McQuade

*Attorney, Agent, or Firm*—Thomas L. Flattery

[57] ABSTRACT

To insure proper alignment of a plug and receptacle connector so that only a correct plug and receptacle are being mated, a set of similarly coded keyways and keys on the connector parts require respective alignment before mating is possible. More particularly, the coupling ring and enclosed plug shell both have a set of keyways (optionally, keys) which must be respectively aligned before the receptacle can be received within the plug shell. A spring biased pawl within a slotted cavity in the coupling ring has parts which upon correct orientation of the ring and plug extend into a recess in the plug shell effectively locking the two together and preventing inadvertent rotation of the coupling ring with respect to the plug shell when the connector parts are unmated. In this way the keyways on the inner surfaces of the coupling ring and plug shell are maintained in properly aligned relation so that they may receive the receptacle. On initial mating of a receptacle within a coupling ring, the receptacle cams the pawl outwardly of the opening in the plug shell thereby now permitting rotation of the coupling ring with respect of the plug shell to complete connector engagement.

5 Claims, 11 Drawing Figures

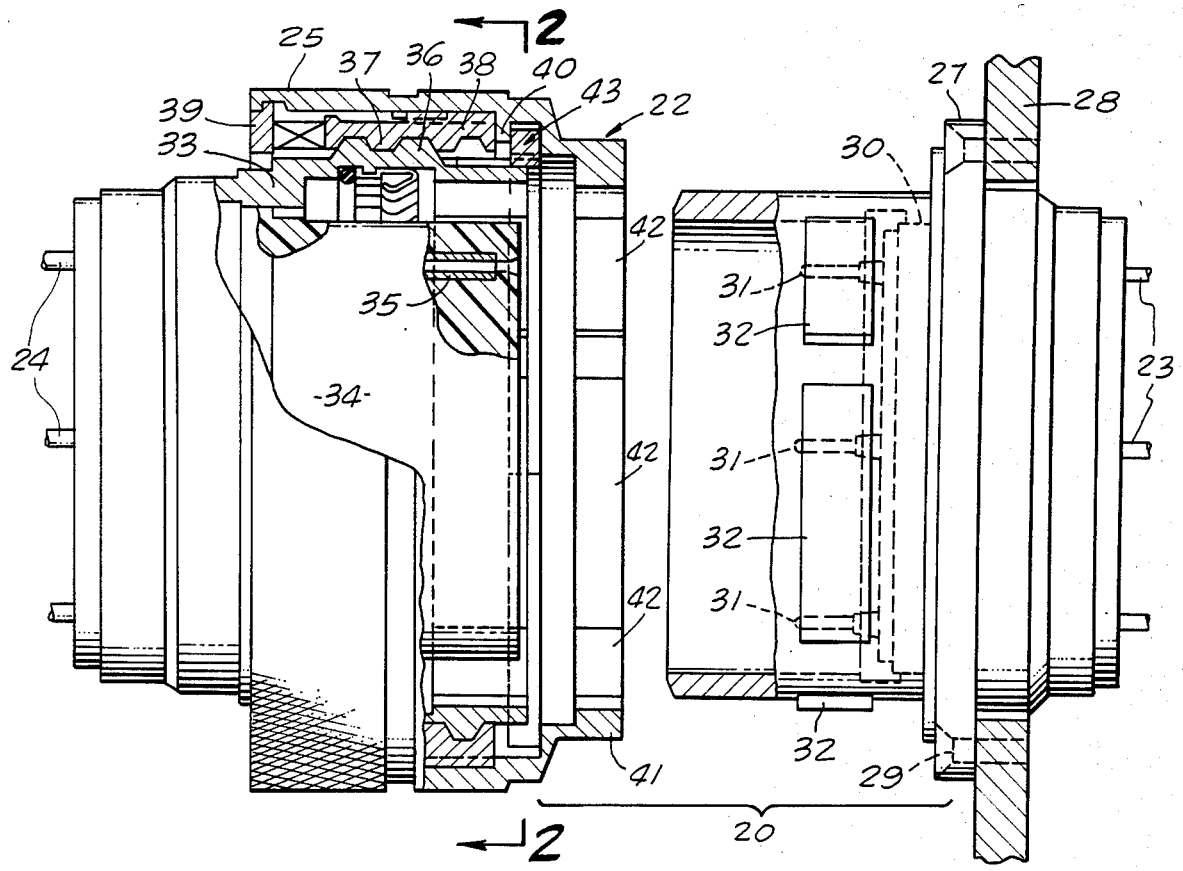
FIG. 1.
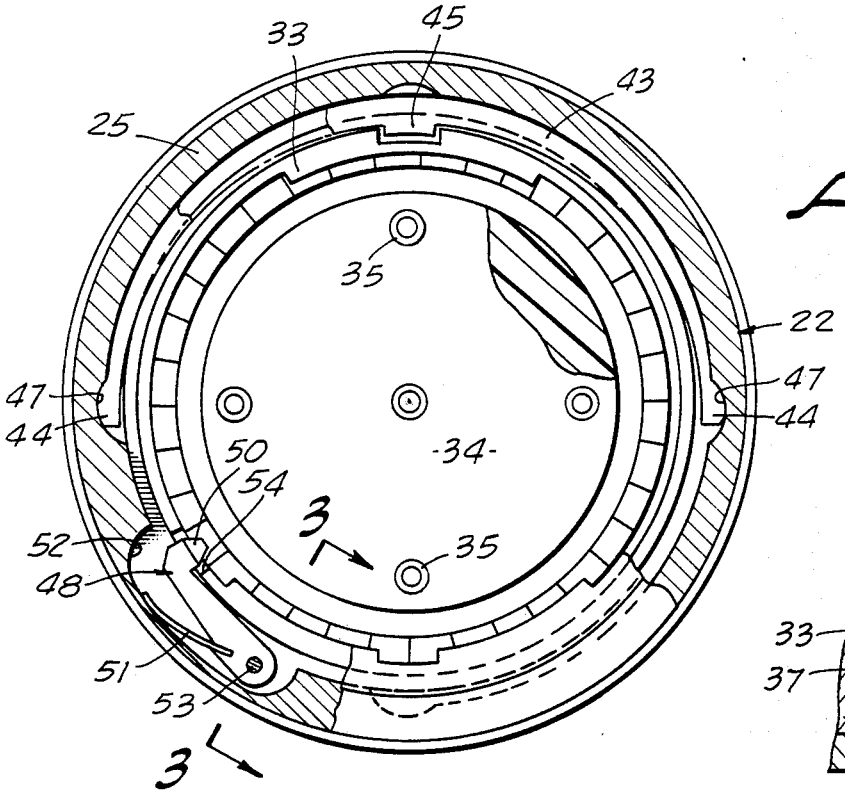
FIG. 2.
FIG. 3.
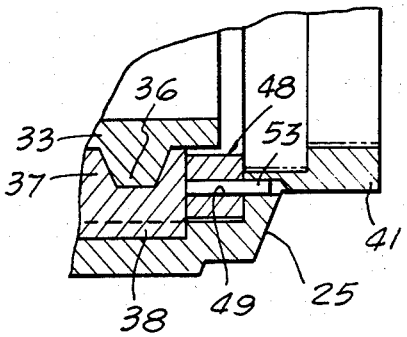

PLUG AND RECEPTACLE CONNECTOR LOCKING MEANS

The present invention relates generally to plug and receptacle electrical connectors, having respective coded means to insure only appropriate connector parts can be mated, and, more particularly to a locking means for maintaining the coded means on a connector part in proper orientation to enable mating of the plug and receptacle.

BACKGROUND AND FIELD OF THE INVENTION

A well received electrical connector with which the present invention is primarily concerned has plug and receptacle parts that are releasably fitted together for electrically interconnecting cable wires. A coupling ring received about the plug is selectively rotatable to drive the connector parts together or apart, depending on the direction of rotation. Successful plug and receptacle electrical connectors are required to operate under adverse environments where they are subjected to such things as vibration, shock, a wide range in temperatures and pressures and restricted available space, to name the major ones.

The inner end surfaces of the coupling housing and included plug shell typically have keyways which are coded to match keys on the receptacle so that only a proper plug and receptacle can be mated together. Occasionally, in prior connectors of this variety the plug and coupling housing can inadvertently be rotated with respect to one another so that the keyways become misaligned and this prevents mating even with a proper receptacle. Although the misalignment can be readily corrected by anyone having rather general operational knowledge of the connector, some users become confused by the misalignment and incorrectly conclude that the connector needs repair.

SUMMARY OF THE DISCLOSURE

A plug and receptacle connector includes a coupling housing which when rotated with respect to the plug as the connector parts are in mating relation moves the plug and receptacle toward or away from each other depending upon the direction of rotation. To insure proper alignment so that only a correct plug and receptacle are being mated, a set of similarly coded keyways and keys on the connector parts require respective alignment before mating is possible. More particularly, the coupling ring and enclosed plug shell both have a set of keyways (optionally, keys) which must be respectively aligned before the receptacle can be received within the plug shell.

A spring biased pawl is received within a slotted cavity in the coupling ring and includes parts extending therefrom which upon correct orientation of the ring and plug extend into a recess in the plug shell effectively locking the two together and preventing inadvertent rotation of the coupling ring with respect to the plug shell when the connector parts are unmated. In this way the keyways on the inner surfaces of the coupling ring and plug shell are maintained in properly aligned relation so that they may receive the receptacle.

On initial mating of a receptacle within a coupling ring, parts of the receptacle cam the pawl outwardly of the opening in the plug shell thereby now permitting rotation of the coupling ring with respect of the plug shell in order to complete engagement of the plug and receptacle to establish electrical connection between the cable wires.

DESCRIPTION OF THE DRAWING

FIG. 1 is a side elevational, sectional view of a plug and receptacle connector shown disengaged.

FIG. 2 is an end elevational, sectional view taken along the line 2—2 of FIG. 1.

FIG. 3 is an enlarged, sectional, partially fragmentary view taken along the line 3—3 of FIG. 2.

DESCRIPTION OF A PREFERRED EMBODIMENT

Figure 4:
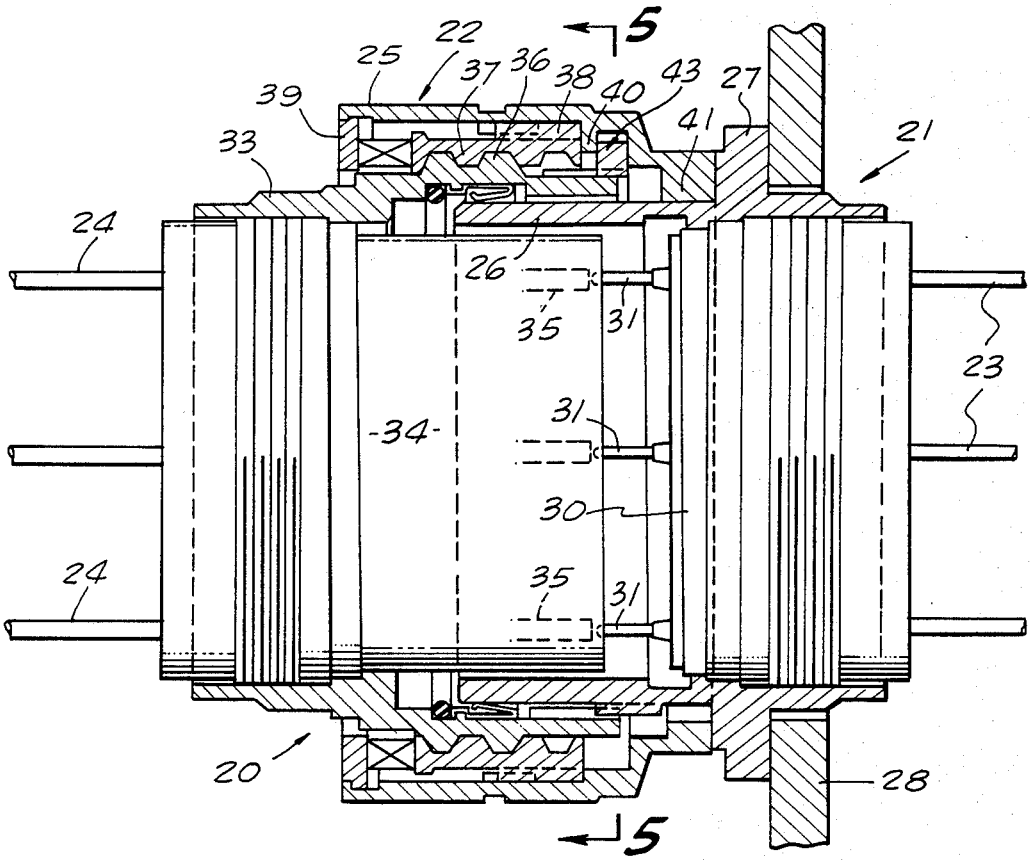
FIG. 4 is a side elevational, sectional view similar to FIG. 1 showing the connector parts during initial stages of mating.

Turning now to the drawings and particularly FIG. 1, there is shown an electrical connector identified generally as at 20 including a receptacle 21 which can be coaxially aligned with and separated from a plug means 22. The electrical connector 20 is effective to couple and electrically connect a plurality of cable wires 23 carried by the receptacle with cable wires 24 mounted in the plug means. As will be more particularly described, the plug means 22 includes a rotatable outer shell or coupling ring 25 which, depending upon the direction of rotation, moves the receptacle and plug means toward one another into mating condition or apart to release them.

Receptacle

The receptacle 21 includes a generally cylindrical shell 26 typically provided with an annular flange 27 which enables mounting of the receptacle to a wall 28, for example, by threaded members 29.

An insulative insert 30 is fittingly received within the shell 26 and has passages for receiving electrical contacts such as the pin contacts 31 (optionally, socket contacts) which are interconnected to the individual cable wires 23 in conventional manner.

The peripheral surface of the receptacle shell 26 includes a set of coded keys 32 which, in a way that will be more particularly described, coact with a similarly coded set of keyways, in the plug means 22 for insuring that only a proper receptacle can be mated with a given means. The receptacle as just described is a conventional construction in providing a fixed predetermined arrangement of pin contacts interconnected with cable wires 23, with electrical continuity maintained and without electrical leakage loss to the metal shell 26.

Plug Means

The plug means 22 includes a plug shell 33 of an internal diameter sufficient to admit the end of the receptacle shell 26 therewithin. An insulative insert 34 is of such geometry and dimensions as to permit fitting receipt within the plug shell 33 and includes a plurality of axially parallel openings within which socket contacts 35 are received, each of which being interconnected in a conventional manner to one of the cable wires 24.

The outer surface of the shell 33 is formed into a set of threads 36 which cooperatively mesh with a similar set of threads 37 on a drive nut 38.

The coupling ring 25 comprises essentially a generally cylindrical metal shell having an internal diameter such as to receive the drive nut 38 therewithin. The drive nut 38 is unitarily secured within the coupling ring so that rotation of the coupling ring simultaneously rotates the nut, and, by virtue of the thread relation with the plug shell, the rotation drives the plug shell axially of the coupling ring.

More particularly, a retainer ring 39 is snapped in place to secure the rear opening of the coupling ring about the drive nut 38 and a shoulder 40 serves a similar function at the front opening of the coupling ring. In this way the coupling ring and nut can be threaded along the plug shell, but cannot be threaded off the plug shell.

The open end of the coupling ring 25 includes a radially inwardly directed flange 41 with an opening just sufficient to accept the open end of receptacle shell 26. In addition, the flange 41 has a plurality of keyways 42 as does the inner end wall surface of the plug 33, which keyways when aligned are so dimensioned and arranged as to permit receipt of the keys 32 on the receptacle shell 26.

As has already been indicated, the pin contacts 31 in the receptacle 21 are arranged in a specific pattern so that in order to effect mating with the socket contacts 35 in the plug means 22 the two connector parts must be oriented into proper alignment. That is, the inserts with contacts must be so arranged within the connector parts that when the keys 32 are aligned with the keyways 42, the pin and socket contacts are also properly aligned.

In the past a problem that was frequently encountered was the inadvertent misalignment of the coupling ring 25 with respect to the plug shell 33 when the connector was unmated or released, so that the keyways 42 of each were not in mutual alignment. When that concurred even though the receptacle shell 26 had its keys properly aligned with the keyways of the coupling ring, the receptacle could still not be mated with the plug means because of the misalignment with the plug means keyways.

Figure 5:
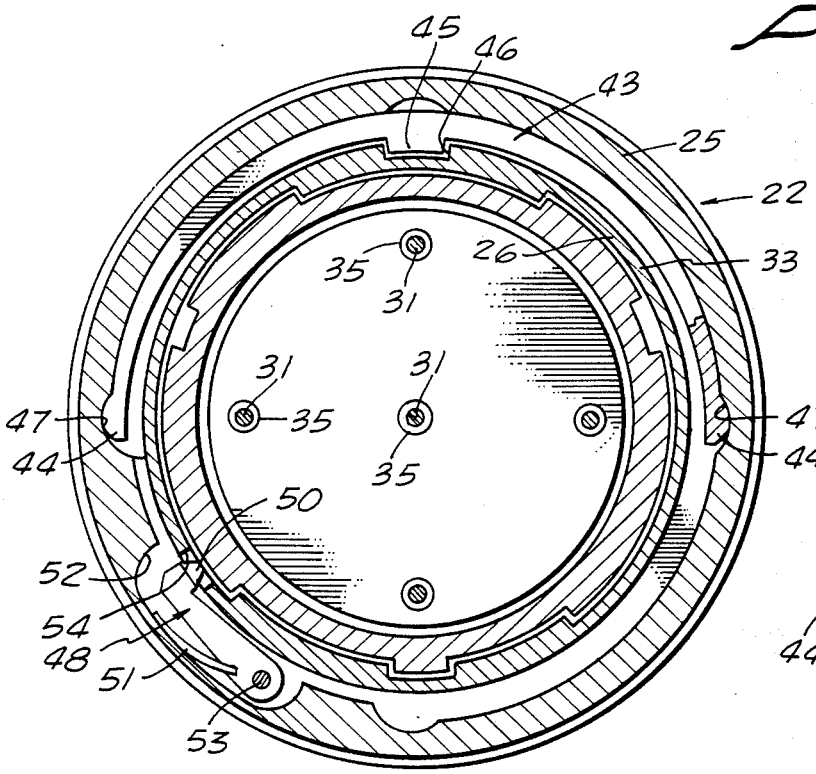
FIG. 5 is an end elevational, sectional view taken along the line 5—5 of FIG. 4.
Figure 6:
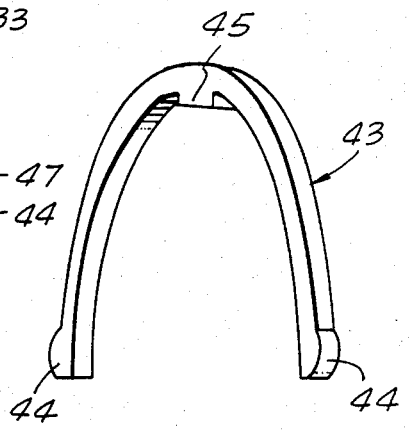
FIG. 6 is a perspective view of a detent spring.
Figure 7:
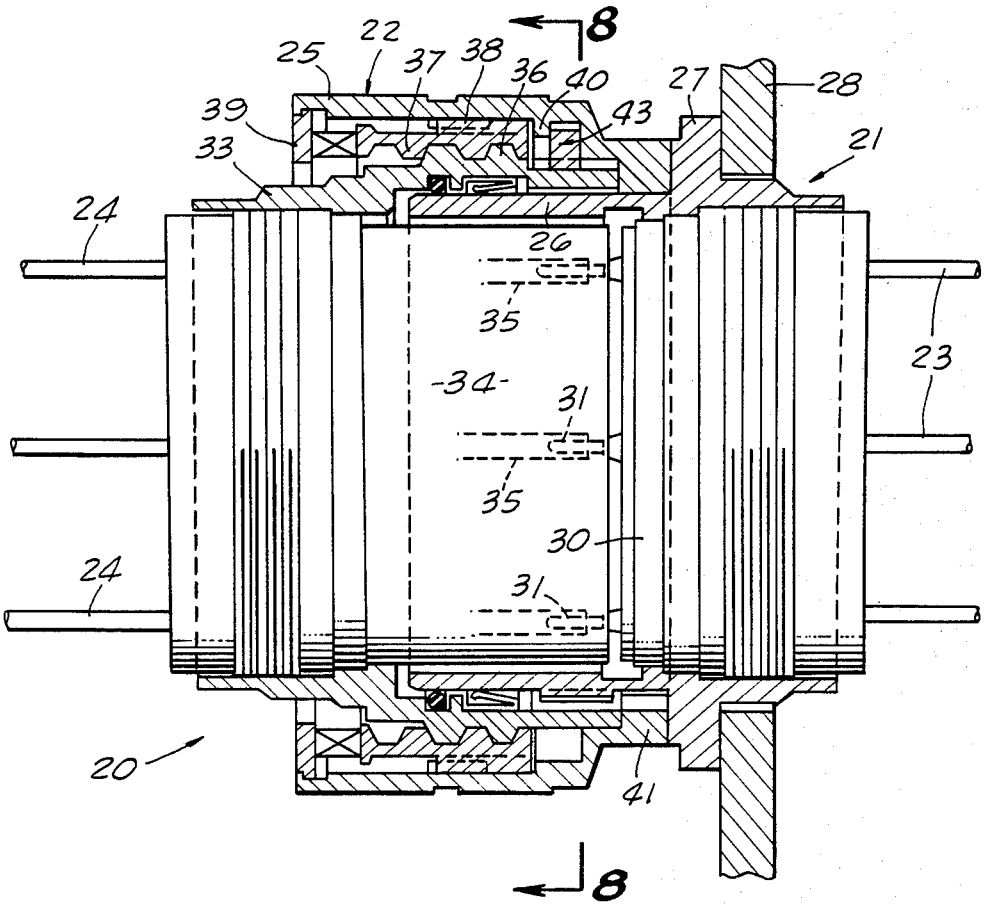
FIG. 7 is a side elevational, sectional view similar to FIG. 4, only showing the connector parts in fully mated condition.

Turning now to FIGS. 2, 5 and 6 simultaneously, there is shown a device which provides both an audible and tactile sensation upon the connector having its various parts brought fully together into mating condition. This device, which is more fully described in U.S. Pat. No. 4,066,315 assigned to the same assignee as this document assists the user of the connector from having a connector only partially mated which could result in the connector later becoming completely disengaged as a result of vibration or shock. As described in this patent, a detent spring 43 is a substantially semicircular metal spring member having outwardly directed projections 44 at each of its ends. The spring is located in a space between the coupling ring 25 and the plug shell 33 with a key 45 on the spring fittingly received within a recess 46 in the outer surface of the plug shell to fixedly locate the spring to the plug shell. Several grooves 47 are appropriately located on the inner wall surface of the coupling ring so that when the connector parts are fully mated as in FIGS. 7 and 8 the projections 44 are received within the grooves 47. More particularly, what occurs is that during rotation of the coupling ring prior to the position shown in FIG. 8, the projections ride on the inner curved surface of the coupling ring and upon the fully mated position of FIG. 8 being reached, the spring action causes the projections to snap downwardly into the grooves 47 producing both tactile and audible sensations evidencing full mating of the connector. A further set of such grooves are provided and appropriately located so that when the connector parts are fully released a similar snapping of the detent spring into the grooves, as shown in FIG. 5, will occur thereby announcing to the user that the connector is disconnected.

Locking Means

Figure 9:
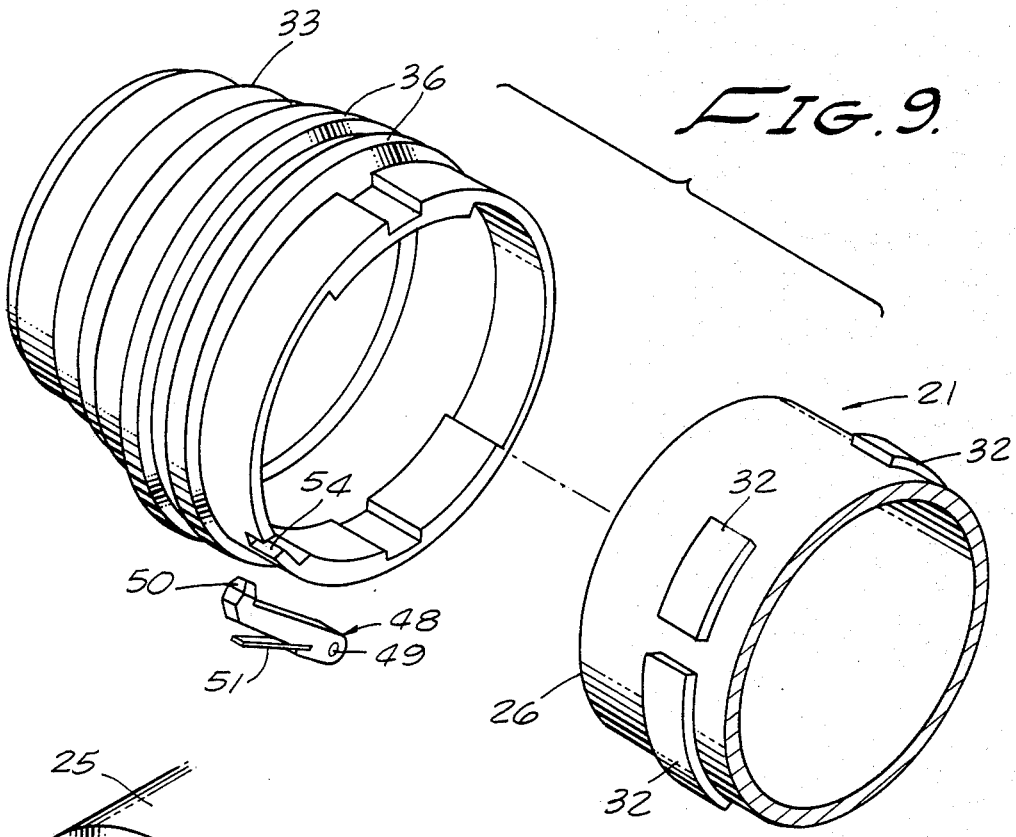
FIG. 9 is a perspective exploded view of a plug shell, receptacle and locking pawls.
Figure 10:
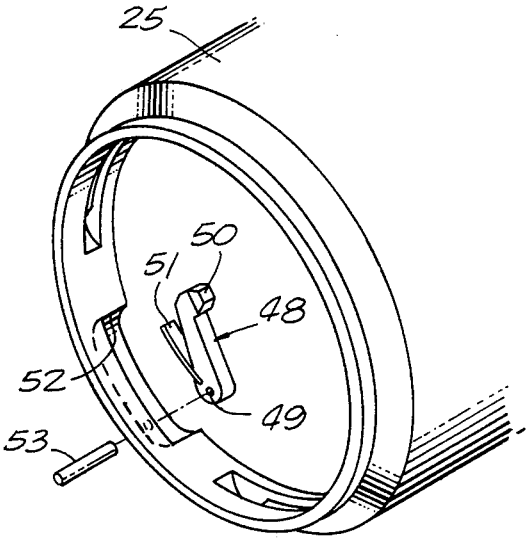
FIG. 10 is a perspective, partially fragmentary view showing the coupling ring and locking pawl.
Figure 11:
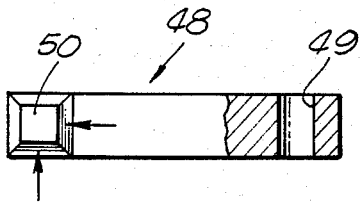
FIG. 11 is an enlarged view of the locking pawl.

For the ensuing description of the locking means to secure the coupling ring 25 and plug shell 33 in a predetermined keyway aligned relation when the connector parts are unmated, reference is now made to FIGS. 9 through 11. A locking pawl 48 includes an enlongated body at one end of which there is a transversely extending opening 49 and at the other end extending away from the main body is a locking head 50. The locking head 50 is generally rectangular with beveled edges for a purpose to be described. An elongated rectangular leaf spring 51 has one end fixedly received within a slot in the pawl adjacent opening 49 and extends angularly away from the pawl body. A cavity 52 formed in the inner wall surface of the coupling ring spaced from the outermost edge of the flange 41 receives the locking pawl therein. More particularly, the cavity 52 extends circumferentially about the flange 41 a sufficient distance to permit the locking pawl 48 to be pivotally mounted therein by pin 53 (FIG. 2). Thus, when mounted in the cavity 52, the locking pawl spring 51 engages the bottom of the cavity and resiliently urges the pawl inwardly toward the plug shell 33.

Figure 8:
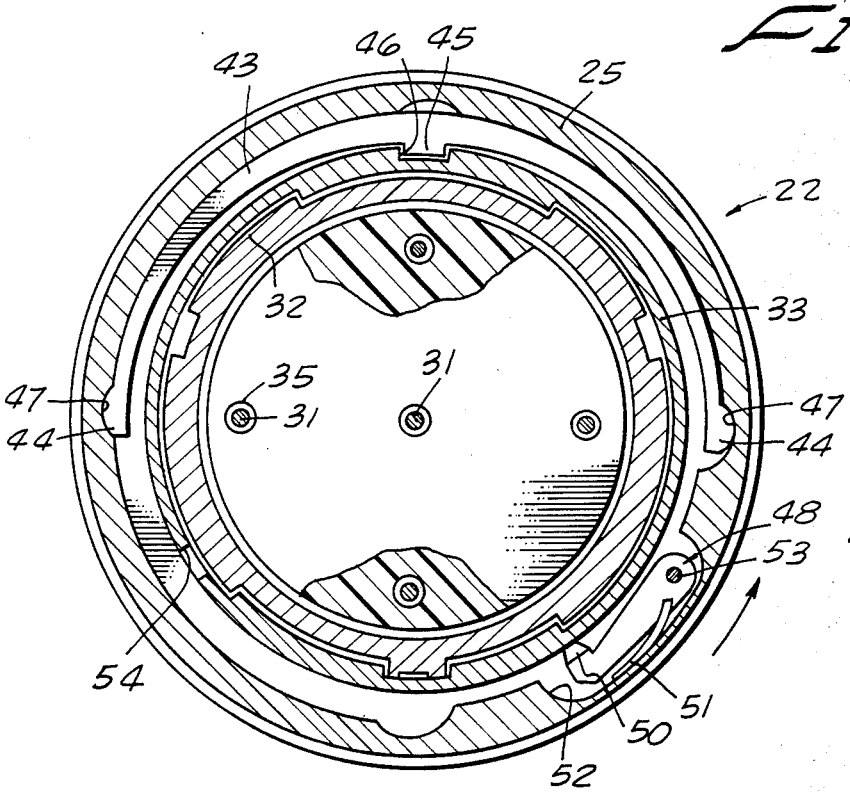
FIG. 8 is an end elevational, sectional view taken along the line 8—8 of FIG. 7.

During most of the rotation of the coupling ring about the plug shell, the pawl locking head 50 rides on the plug shell outer surface as shown in FIG. 8. When the coupling ring and plug shell are brought to that relative orientation where their respective keyways 42 are precisely aligned, an opening 54 in the plug shell receives the pawl locking head 50 therein which locks the coupling ring and plug shell against relative rotation (FIG. 2). It is to be noted that on interlock the tip end of head 50 extends inwardly of the plug shell wall into the space where the receptacle is located during connector mating.

On insertion of the receptacle into the open end of the coupling ring and plug shell as shown in FIG. 5, a key 32 on the receptacle shell outer surface engages the tip of pawl locking head 50 moving it partially from the opening 54 in the plug shell. When this is done, rotation of the coupling ring with respect to the plug is not prevented by the interlock and instead locking head 50 is readily cammed from opening 54 and rides on the plug shell outer surface as shown in FIG. 8. Camming of the locking head from opening 54 is aided by the beveled head edges (arrows in FIG. 11).

As to further connector mating operation, when the receptacle is moved into the open end of the coupling ring and plug shell (with keyways aligned) a point is reached at which the coupling ring flange 41 is located behind the keys 32 on the receptacle as in FIG. 4. Rotation of the coupling ring now locks the flange 41 behind the keys 32, with continued rotation pulling the plug and receptacle together until fully mated as in FIG. 7.

I claim:

1. A releasable locking means for an electrical connector having a receptacle shell receivable within a plug shell and a coupling ring shell and rotatable to drive the plug and receptacle shell toward or away from each other depending on the direction of rotation, comprising:

a pawl mounted on an inner surface of the coupling ring shell;

spring means resiliently urging the pawl into contact with plug shell;

said plug shell including an opening in a plug shell wall through which a part of the pawl is urged by the spring means when the coupling ring shell is threaded on the plug shell to the point of release of the receptacle shell to lock the coupling ring shell against relative movement with respect to the plug shell, and said receptacle shell on being received within the plug shell engages the pawl part extending through the plug shell opening and moves said pawl part to a position enabling relative movement between said plug and coupling ring shells.

2. A releasable locking means as in claim 1, in which said pawl is elongate, one end of said pawl being pivotally connected to the coupling ring shell and the other pawl end being formed into the pawl part.

3. A releasable locking means as in claim 2, in which the pawl part includes beveled edges on an end thereof.

4. A releasable locking means as in claim 2, in which the spring means includes a leaf spring resiliently contacting both the pawl and coupling ring shell.

5. A releasable locking means as in claim 1, in which the internal surfaces of the coupling ring and plug shells are formed into a coded set of keyways which are aligned when locked by said pawl so as to permit receipt of a receptacle shell having a similarly coded set of keys on its outer surface.

* * * * *